US006802643B1

(12) United States Patent
Cato, Jr. et al.

(10) Patent No.: US 6,802,643 B1
(45) Date of Patent: Oct. 12, 2004

(54) SELF-ANCHORING MAST FOR DEPLOYING A HIGH-SPEED SUBMERSIBLE MIXER IN A TANK

(75) Inventors: Joseph E. Cato, Jr., Aiken, SC (US); Paul M. Shearer, Aiken, SC (US); Philip O. Rodwell, Evans, GA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 288 days.

(21) Appl. No.: 10/045,108

(22) Filed: Jan. 15, 2002

(51) Int. Cl.[7] ..... B01F 5/12

(52) U.S. Cl. ..... 366/262; 366/285

(58) Field of Search ..... 366/262, 264, 366/265, 270, 285, 286

(56) References Cited

U.S. PATENT DOCUMENTS 5,366,289 A * 11/1994 Supelak

* cited by examiner

*Primary Examiner*—Terry K. Cecil
(74) *Attorney, Agent, or Firm*—Esther L. Roberts; Julia Cook Moody; Paul A. Gottlieb

(57) ABSTRACT

A self-anchoring mast for deploying a high-speed submersible mixer in a tank includes operably connected first and second mast members (20, 22) and a foot member 46 operably connected to the second mast member for supporting the mast in a tank. The second mast member includes a track (36, 38) for slidably receiving a bearing of the mixer to change the orientation of the mixer in the tank.

8 Claims, 4 Drawing Sheets

SELF-ANCHORING MAST FOR DEPLOYING A HIGH-SPEED SUBMERSIBLE MIXER IN A TANK

GOVERNMENT INTERESTS

The U.S. Government has rights in this invention pursuant to Contract No. DE-AC09-96SR18500 between the U.S. Department of Energy and Westinghouse Savannah River company.

FIELD AND HISTORICAL BACKGROUND OF THE INVENTION

This invention was made with Government support under a contract awarded by the U.S. Department of Energy. The Government has certain rights in the invention.

The present invention is directed to the deployment of submersible mixers in a tank, and more particularly to a self-anchoring mast for deploying a high-speed submersible mixer in high-level waste (or other industry) tanks to allow the contents to be agitated for processing or transfer.

Installation of submersible mixing or agitation equipment in tanks usually requires internal attachment and/or support structures, within the tank, to affix the mixer to the tank wall or floor. This is particularly true when high-energy machines, such as the 50 HP Flygt mixer are installed, in order to safely anchor the unit, to remain stable under the machine's 1,600 pounds of reaction thrust from a high speed (860 RPM) propeller. If the tank is not originally built with the necessary anchoring systems, personnel must enter the tank to install the anchoring systems. Otherwise, high energy mixers cannot be considered without some other (external) support structure. In hazardous industrial tank applications, such as chemical, volatile or radioactive tanks, this factor alone often precludes high energy mixer installation or requires extensive external support systems.

Further, it is often found that deployment of smaller scale agitation equipment is attempted in a tank with the use of cumbersome and expensive tank top superstructures to support the agitator and to provide reaction capability for the mixer's thrust. In case of large units, such as the 50 HP/1600 pounds thrust of a rotating mixer mast assembly (and larger units), the extremely large bending moment created by the mixer thrust reacted through a 40 to 45 foot moment arm, make the forces and required superstructures prohibitively large and expensive. For example, the 1,600 pound thrust of the subject unit reacted through a 45 foot tank top structure would require a mast and tank-top superstructure capable of resisting a bending moment of more than 72,000 pounds (without a safety margin) before the unit could be expected to remain stable within the tank. Similar large scale superstructures for full scale waste tanks cost hundreds of thousands of dollars to millions of dollars to design and install when related factors, such as structural loading, tank and superstructure codes and hazard ratings, seismic and other natural phenomena design are taken into account.

Masts built for radioactive waste tank deployments also require incorporation of a segmented design to facilitate removal of top sections for temporary radiological containment packaging for eventual reuse or final disposal.

Therefore, there is a need in the industry for a mast which is self-anchoring and can be quickly deployed in a tank without having to provide support components internally or external to the tank.

SUMMARY AND OBJECTS OF THE INVENTION

The principal object of the present invention is to provide a self-anchoring mast for deploying a high-speed submersible mixer in a tank which can be quickly deployed, for example, within 30–60 minutes, in a tank with no prior fixtures, supports or other attachments needed within the tank to anchor it for operation.

An object of the present invention is to provide a self-anchoring mast for deploying a high-speed submersible mixer in a tank which is preferably about 7,000 pounds center-loaded and allows a high energy mixer, such as a 50 HP mixer, to be lowered into a tank while properly anchoring the entire mast system against the mixer thrust. Smaller mixers with lesser reaction thrust can also be deployed by using similar lighter masts, and larger masts may be used for larger or more powerful mixers, both without the requirement of fixed internal anchors or supports within the tank. In summary, the mast of the invention can be easily used as a tool for installing or deploying small to high energy mixing systems. Another object of the present invention is to provide a self-anchoring mast for deploying a high-speed submersible mixer in a tank which deploys vertically through tank-top openings as small as twenty-two inches.

Yet another object of the present invention is to provide a self-anchoring mast for deploying a high-speed submersible mixer in a tank wherein the mixer can operate vertically and be remotely repositioned within the tank for horizontal discharge.

An additional object of the present invention is to provide a self-anchoring mast for deploying a high-speed submersible mixer in a tank wherein the mixer can be remotely raised and lowered to operate at any level within the tank.

Yet an additional object of the present invention is to provide a self-anchoring mast for deploying a high-speed submersible mixer in a tank which does not require any tank top superstructure.

Still yet an additional object of the present invention is to provide a self-anchoring mast for deploying a high-speed submersible mixer in a tank in which a motorized tank top rotation system allows a user to set the rate and sweep angles of up to 360°.

Still yet an additional object of the present invention is to provide a self-anchoring mast for deploying a high-speed submersible mixer in a tank which can be quickly installed or removed from the tank with a portable crane.

A further object of the present invention is to provide a self-anchoring mast for deploying a high-speed submersible mixer in a tank which allows effective and efficient agitation of the tank contents by allowing the mixer to be periodically reoriented and/or rotated to direct the mixer discharge to different areas or zones of the tank. The rotation capability allows a single mixer to mix more areas of each tank. Further, the "sweep" angle of rotation, as well as the speed of sweep or rotation, are easily variable in order to focus mixer discharge on certain areas of the tank and to help coordinate single or multiple mixers in a larger tank with each other and with the overall fluid motion in the tank.

In summary, the main object of the present invention is to provide a mast for deploying a high-speed submersible mixer in a tank which is self-anchoring and allows the mixer/mast assembly to be quickly deployed in the tank with no prior fixtures, supports or other attachments needed within the tank to anchor it for operation.

In accordance with the present invention, a self-anchoring mast for deploying a high-speed submersible mixer in a tank, includes a first (or upper) mast member, a second (or lower) mast member operably connected to the first mast member, and a foot member operably connected to the second mast member for supporting the mast in a tank.

BRIEF DESCRIPTION OF THE DRAWINGS

The above and other objects, novel features and advantages of the present invention would become apparent from the following detailed description of the invention, illustrated in the drawings, in which.

DETAILED DESCRIPTION OF THE INVENTION

Figure 1:
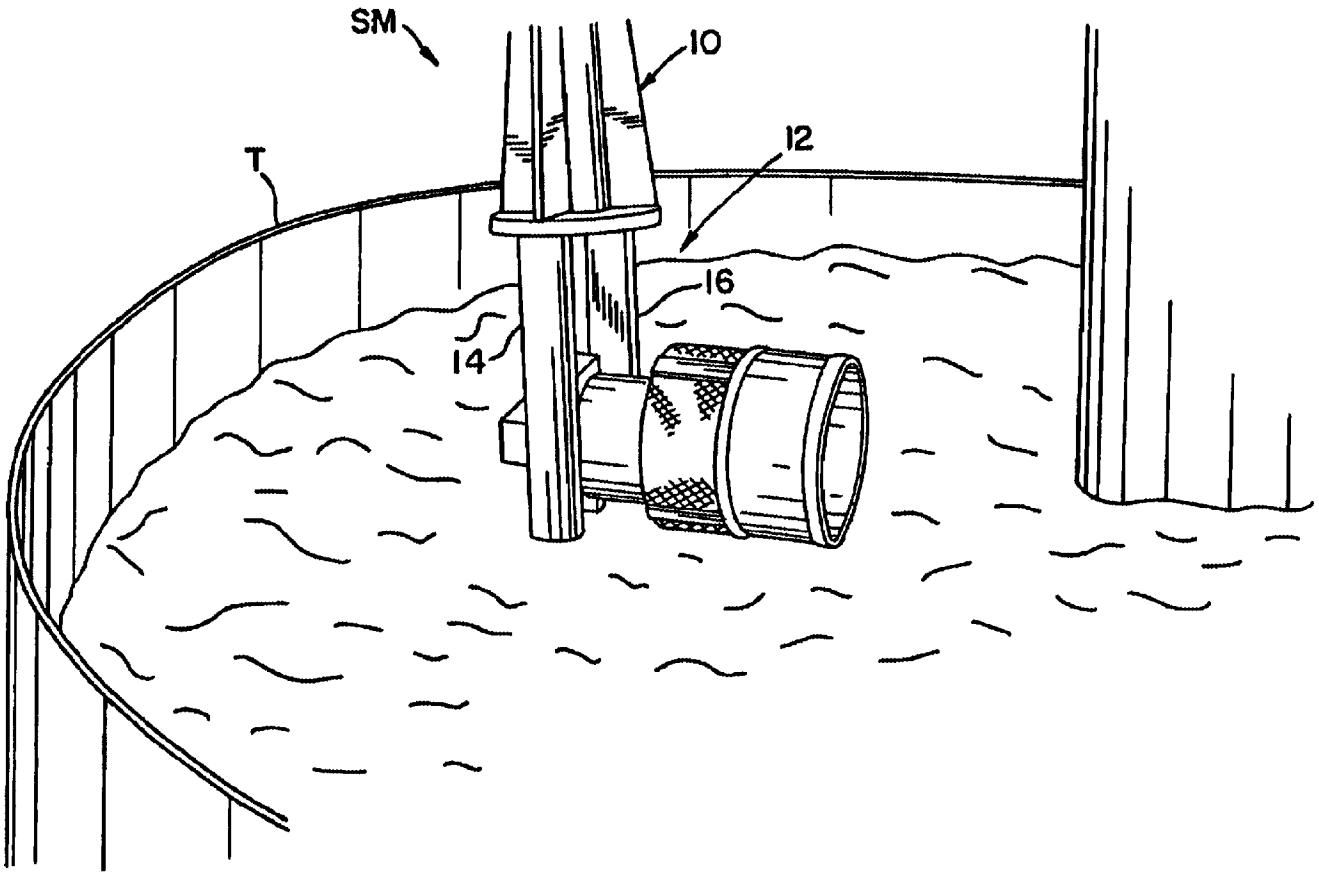
FIG. 1 is an elevational view a stationary mast of the invention, shown being lowered in a tank.

As best shown in FIG. 1, a stationary mast assembly SM of the invention, shown being lowered in a tank T, includes an upper mast member 10 and a lower mast member 12 in the form of two laterally spaced supports 14 and 16. As shown, a mixer M is mounted in between the supports 14 and 16.

Figure 2:
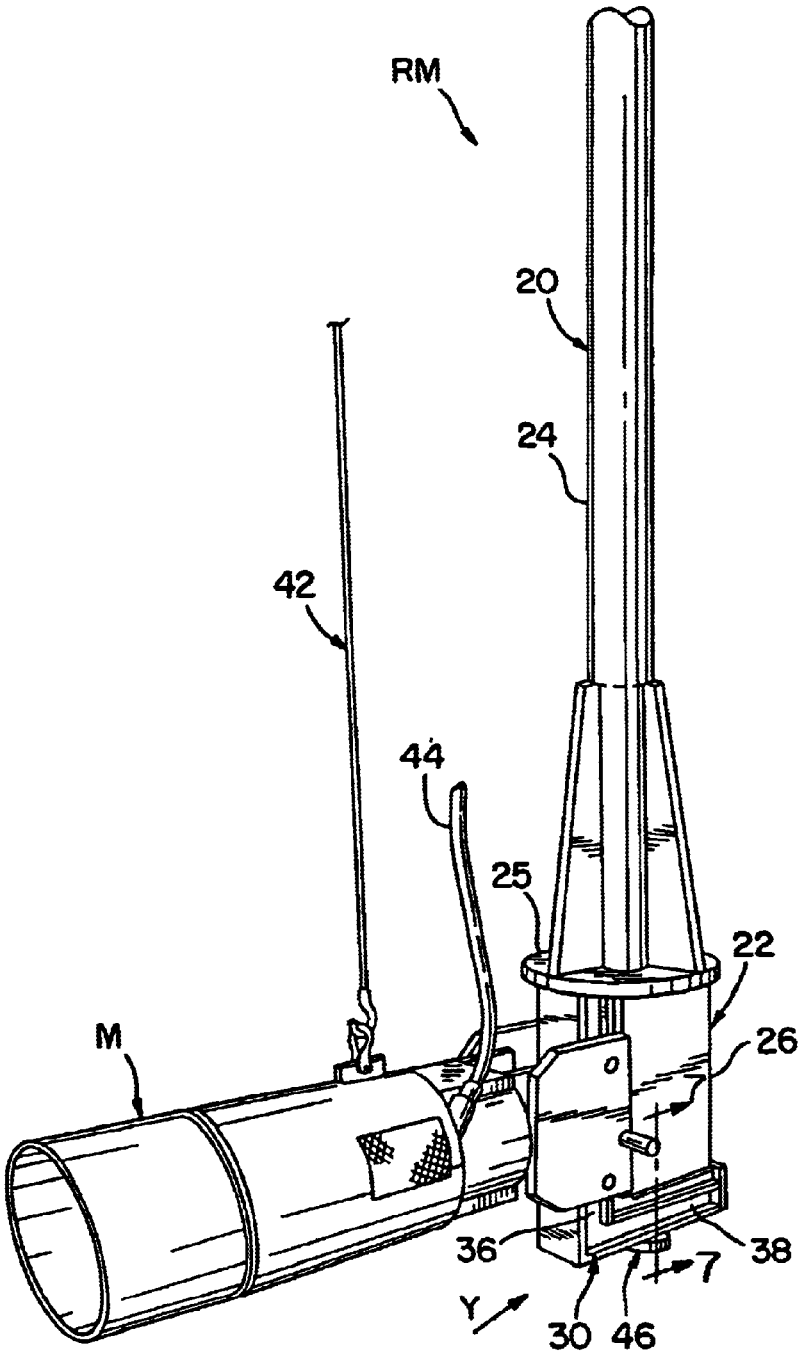
FIG. 2 is a elevational view of a rotatable mast of the invention, shown with a mixer in a horizontal position.

As best shown in FIG. 2, a rotatable mast assembly RM of the invention, includes an upper mast member 20 and a lower mast member 22. The upper mast member 20 includes a hollow pipe 24, preferably eight inches in diameter and filled with concrete, with a rounded and flanged base 25 for mounting and bolting to a similar flanged surface on the lower mast member 22.

Figures 3, 4:
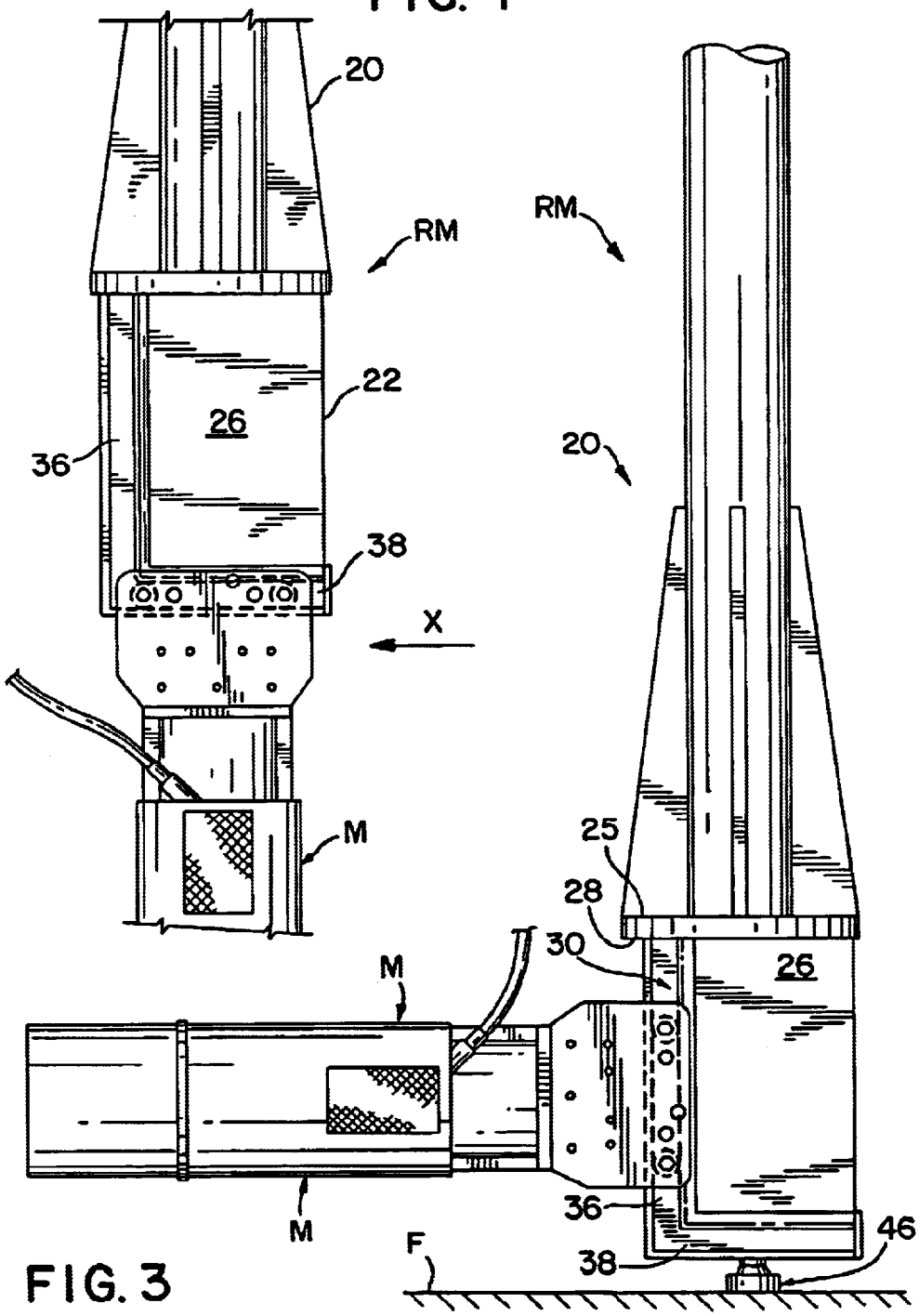
FIG. 3 is an enlarged view of the rotatable mast shown in FIG. 2, shown positioned on the bottom of a tank.
FIG. 4 is an enlarged view of the rotatable mast shown in FIG. 2, showing the mixer in a vertical position prior to being deployed in a tank.
Figure 5:
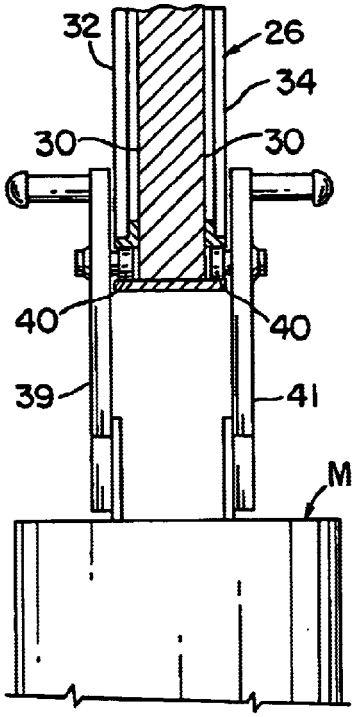
FIG. 5 is a partial, enlarged view taken in the direction of arrow X in FIG. 4.
Figure 6:
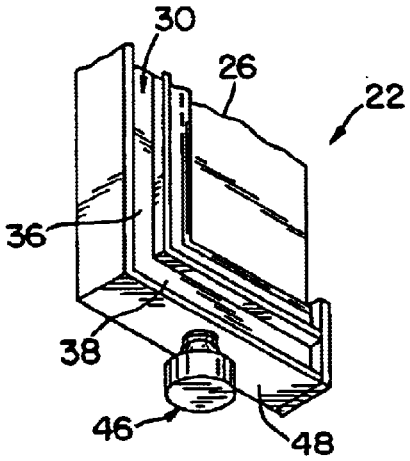
FIG. 6 is a partial, enlarged bottom perspective view taken in the direction of arrow Y in FIG. 2.

As best shown in FIGS. 2, 3 and 6, the lower mast member 22 is in the form of a rectangular block 26 mounted to the bottom 28 of base 25. The block 26 includes a L-shaped track 30 on each side 32 and 34 thereof (FIG. 5). Each track 30 includes a vertically extending portion 36 and a horizontally extending section 38 defining a continuous recess therebetween. The track 30 is dimensioned to receive cam follower or bearing units 40 of the mixer M mounted on the support plates 39 and 41 thereof (FIG. 5). The bearings 40 slide or travel in the track 30 thereby allowing the mixer M to be positioned horizontally in a deployed position (FIG. 2), or in a down position prior to deployment in a tank (FIG. 4). In order to move the mixer M between the down and deployed positions and to adjust its position within a tank, a manual or powered hoist mechanism 42 is connected to the mixer M. In FIG. 2, reference numeral 42 designates a submersible mixer power cable for the mixer M.

Figure 7:
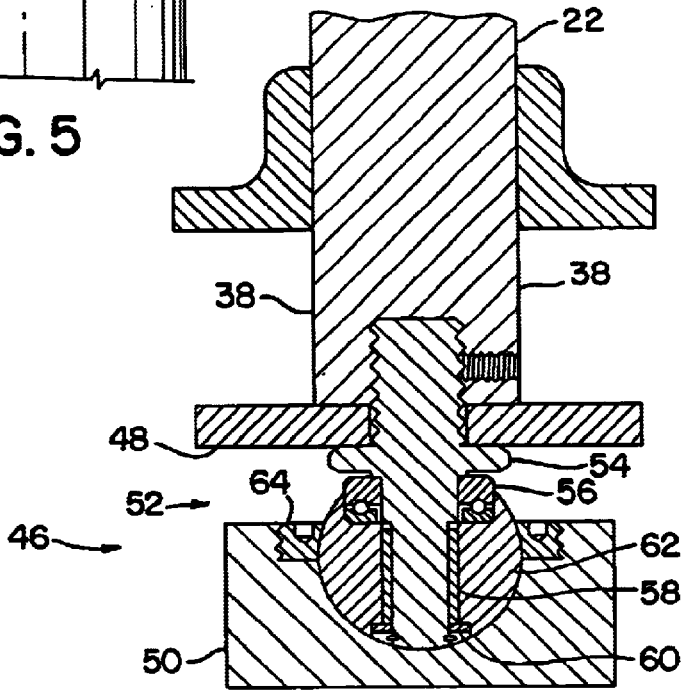
FIG. 7 is view taken along line 7—7 of FIG. 2.

In order to support the mast RM on the floor F of tank T, a foot assembly 46 is mounted at the bottom 48 of the lower mast member 22. As best shown in FIG. 7, the foot assembly 46 includes a base 50 and a load bearing assembly 52. A threaded shaft 54 connects the bearing assembly 52 with the bottom 48 of the lower mast member 22. In FIG. 7, reference numerals 56, 58 and 60 designate a thrust bearing, a bushing and a spacer, respectively. Likewise, reference numeral 62 designates a pivot ball, and reference numeral 64 designates a retainer plate for pivot ball 62.

The foot assembly 46 not only supports the entire weight of the mast RM and mixer M (which is typically more than 7,000 pounds) on the tank floor F, but also provides the necessary frictional force to maintain the mast RM anchored to the floor F, and allows the mast RM carrying the mixer M, to be rotated through sweep angles up to 360°. It is noted that since the tank floors could have surface irregularities, the overall configuration of the foot assembly 46 provides automatic angle adjustment, upon landing, to assure the necessary stability and support for the mast RM.

Although not shown, a motorized rotation system would be provided adjacent the top of the upper mast member 20 to provide power to rotate the mast RM. Preferably, the rotation system would include user-adjustable sweep angle trip arms, sweep travel limit switch and sweep reversal time delay to allow each mast SM/RM to be set for the range or degree of sweep desired within a tank, with a user-selected time delay between one direction of sweep travel and the subsequent (reversed) direction of sweep. The mast SM/RM may also be equipped with programmable logic controllers (PLC's), to allow the operating patterns (sweep rate, hold time at various tank positions, positions relative to other masts, etc.) of multiple mast assemblies, within the same tank, to be totally synchronized and programmed.

The novel construction of the rotatable mast RM of the invention, allows a user to adjust and operate the mixer M in its horizontal discharge position for any liquid level within the tank. This is accomplished by the L-shaped track 30 provided on the block 26 of the lower mast member 22. In particular, the elevation of the mixer M within the tank can be easily changed by allowing the mixer bearings 40 to ride in the track 30. This feature not only allows the mixer M to gradually "mix" its way down into a tank with large bottom deposits, but also allows the mixer M to continue to adjust and operate (mix) as a tank is draining or the mix slurry is being pumped down. This is believed to be a valuable feature as this process continues to deliver increasing mixing energy, per unit of liquid volume, to the same tank as the tank liquid level decreases. This additional energy per unit volume of the fluid is widely recognized as providing significant improvements to the effectiveness of process mixing, particularly in partially mixed tanks. Further, this allows the mixer level to be easily readjusted in the event multiple mixing cycles (refilling the tank to allow continued mixing of residual contents) need to be preformed with successive tank liquid levels. The refilling/re-mixing can be carried out by utilizing the mast RM of the invention to clean waste tanks and prepare them for final closure. This process can also be used for tank cleaning in industrial applications.

While this invention has been described as having preferred ranges, steps, materials, or designs, it is understood that it is capable of further modifications, uses and/or adaptations of the invention following in general the principle of the invention, and including such departures from the present disclosure, as those come within the known or customary practice in the art to which the invention pertains and as may be applied to the central features hereinbefore set forth, and fall within the scope of the invention and of the appended claims. It is further understood that the present invention is not limited to the claims appended hereto.

PARTS LIST

SM Stationary mast assembly
RM Rotatable mast assembly
M Mixer
T Tank
F Tank floor
10 Upper mast member of SM
12 Lower mast member of SM
14 & 16 Supports
20 Upper mast member of RM
22 Lower mast member of RM
24 Pipe
25 Base of upper mast member 20
26 Block
28 Bottom of base 25
30 L-shaped track
32 & 34 Sides of block 26

36 Vertical section of track 30
38 Horizontal section of track 30
39 Support plate
40 Bearings
41 Support plate
42 Hoist mechanism
44 Power line
46 Foot
48 Bottom of lower mast member 22
50 Base
52 Load bearing assembly
54 Pin
56 Thrust bearing
58 Bushing
60 Spacer
62 Pivot ball
64 Retainer plate

What is claimed is:

1. A self-anchoring mast that deploys a high-speed submersible mixer in a tank, comprising:

a) a first mast member;

b) a second mast member operably connected to said first mast member; and c) a foot member operably connected to said second mast member to support said self-anchoring mast in a tank;

said second mast member comprising attachment means connecting a mixer thereto, said attachment means comprising first and second tracks forming a continuous recess, said first track extending in a first direction and said second track extending in a second direction different from said first direction, said continuous recess slidably receiving a bearing of the mixer for changing the orientation thereof.

2. The mast of claim 1, wherein:

said first and second tracks are aligned at approximately a right angle.

3. The mast of claim 1, wherein:

said first track extends in a first direction that is axial and in the same direction as said first mast member; and said second track extends in a second direction at approximately a right angle to said first direction.

4. The mast of claim 3, wherein:

said foot member includes a support base and a bearing assembly;

said bearing assembly is fixedly attached to said second mast member; and wherein said second mast member is rotatable relative to said support base.

5. A self-anchoring mast that deploys a high-speed submersible mixer in a tank, comprising:

a) an upper mast member;

b) a lower mast member operably connected to said upper mast member;

c) a foot member operably connected to said lower mast member to support said self-anchoring mast in a tank;

d) said lower mast member including attachment means connecting a mixer thereto; and e) said attachment means comprising first and second tracks forming a continuous recess slidably receiving a bearing of the mixer for changing the orientation thereof, said first track extending in a first direction and said second track extending in a second direction different from said first direction.

6. The mast of claim 5, wherein:

said first track extends axially in the same direction as said upper mast member.

7. The mast of claim 6, wherein:

said second track extends at approximately a right angle to said upper mast member.

8. The mast of claim 7, wherein:

said foot member includes a support base and a bearing assembly;

said bearing assembly is fixedly attached to said lower mast member; and wherein said lower mast member is rotatable relative to said support base.

* * * * *